US005803602A

United States Patent [19]

Eroglu et al.

[11] Patent Number: 5,803,602

[45] Date of Patent: Sep. 8, 1998

[54] FLUID MIXING DEVICE WITH VORTEX GENERATORS

[75] Inventors: Adnan Eroglu, Untersiggenthal; Wolfgang Polifke, Windisch, both of Switzerland; Peter Senior, Leicestershire, United Kingdom

[73] Assignee: ABB Research Ltd., Zurich, Switzerland

[21] Appl. No.: 744,270

[22] Filed: Nov. 6, 1996

[30] Foreign Application Priority Data

Dec. 1, 1995 [DE] Germany ..... 195 44 816.2

[51] Int. Cl.[6] ..... B01F 5/00

[52] U.S. Cl. ..... 366/337; 138/37

[58] Field of Search ..... 366/181.5, 336–340; 165/109.1; 48/189.4; 138/37–39, 114

[56] References Cited

U.S. PATENT DOCUMENTS

| | | | |
|---|---|---|---|
| 1,022,493 | 4/1912 | Meigs | 138/37 |
| 1,454,196 | 5/1923 | Trood | 48/189.4 |
| 1,466,006 | 8/1923 | Trood | 48/189.4 |
| 3,051,452 | 8/1962 | Nobel | 366/337 |
| 3,239,197 | 3/1966 | Tollar | 138/42 X |
| 3,404,869 | 10/1968 | Harder | 366/338 |
| 3,557,830 | 1/1971 | Raw | 366/337 X |
| 3,671,208 | 6/1972 | Medsker . | |
| 3,893,654 | 7/1975 | Miura et al. . | |
| 4,164,375 | 8/1979 | Allen | 366/337 |
| 4,461,579 | 7/1984 | McCallum . | |
| 5,423,608 | 6/1995 | Chyou et al. | 366/337 |
| 5,518,311 | 5/1996 | Althaus et al. | 366/181.5 |

FOREIGN PATENT DOCUMENTS

| | | |
|---|---|---|
| 0619133A1 | 10/1994 | European Pat. Off. . |
| 0619134A1 | 10/1994 | European Pat. Off. . |
| 2723056 | 12/1977 | Germany . |
| 2842156 | 4/1979 | Germany . |
| 3116557A1 | 11/1982 | Germany . |

*Primary Examiner*—Charles E. Cooley
*Attorney, Agent, or Firm*—Burns, Doane, Swecker & Mathis, L.L.P.

[57] ABSTRACT

A mixing device for mixing two or more flowing fluids in a flow duct in which the fluids to be mixed flow along a dividing wall (22), includes a plurality of vortex generators mounted on a downstream end of the dividing wall. The vortex generators (9) have surfaces which project into the duct, and around which flow occurs freely. Each vortex generator includes two side surfaces connected at a lead connecting edge which stands perpendicularly to the dividing wall (22) and is the edge acted upon first by the flow. A top surface consists of two sectional top surfaces (1, 2) which are connected to one another via a top connecting edge (10). Downstream rear edges (5, 6) of the sectional top surfaces (1, 2) are oriented at an angle (γ) with the dividing wall (22), as a result of which, the the rear edges (5, 6) lie on an opposite side of the dividing wall (22)), with respect to the side surfaces (11, 13). A base surface consists of two sectional base surfaces which are connected to one another by a base connecting edge and to the sectional top surfaces by the rear edges (5, 6).

7 Claims, 2 Drawing Sheets

Fig. 4
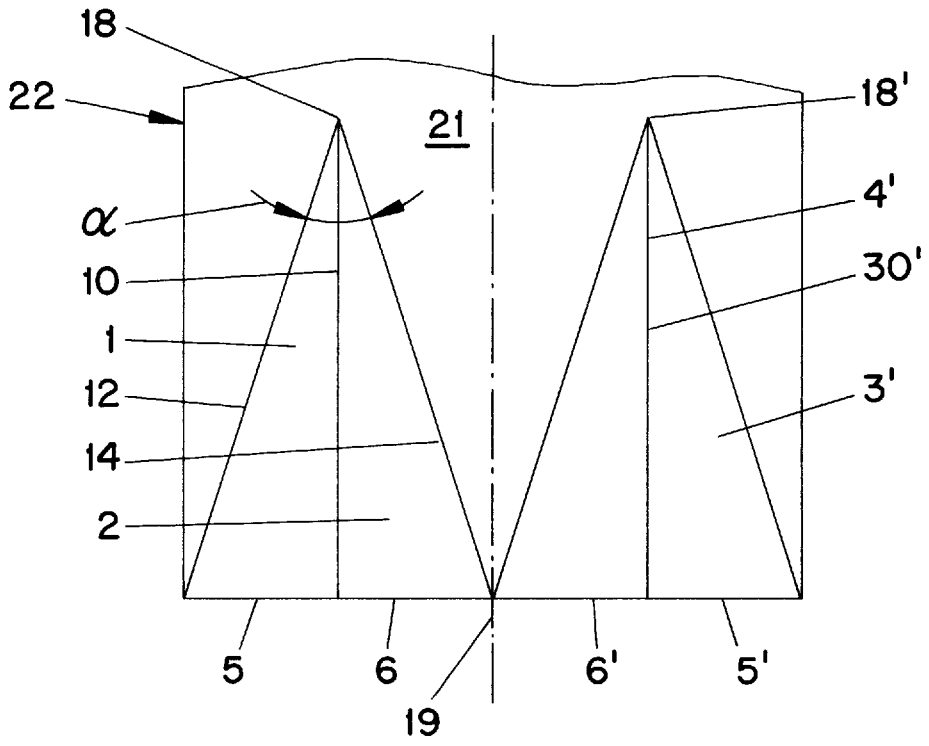
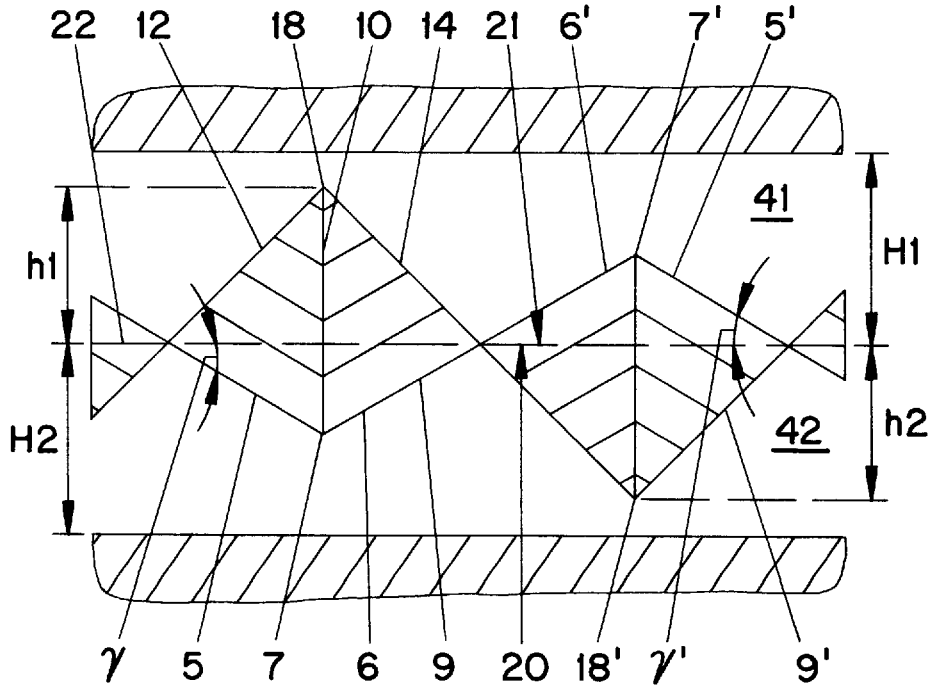
Fig. 5

FLUID MIXING DEVICE WITH VORTEX GENERATORS

BACKGROUND OF THE INVENTION

1. Field of the Invention

The invention relates to a mixing device for mixing two or more fluids which can have the same or a dissimilar mass flow, the fluids to be mixed flowing along a dividing wall on whose downstream end a plurality of vortex generators having surfaces around which flow occurs freely are arranged, of which vortex generators a plurality are arranged next to one another, the side surfaces of the vortex generator being flush with one side of the dividing wall and enclosing with one another the sweepback angle, the longitudinally directed edges of the side surfaces running at a setting angle to the wall, and the two side surfaces enclosing with one another a connecting edge which preferably runs perpendicularly to the wall and is the edge acted upon first by the flow.

2. Discussion of Background

EP-A1-0 619 134, for example, discloses such mixing devices. In many sectors, such as, for example, chemicals, food or pharmaceuticals production, etc., fluids are required to be intimately mixed in the quickest way. The quality of the entire process mostly depends on the mixing quality achieved. The pressure drop during the mixing operation should at the same time remain within "reasonable" limits in order to keep down the process costs through low pumping work.

SUMMARY OF THE INVENTION

Accordingly, one object of the invention in a mixing device of the type mentioned at the beginning is to improve the intermixing.

According to the invention, this is achieved in that

- a top surface consists of two sectional top surfaces, the longitudinally directed edges of the sectional top surfaces being flush with the edges of the side surfaces, and the sectional top surfaces being connected to one another via a connecting edge,
- the downstream rear edges of the sectional top surfaces enclose an angle with the dividing wall, as a result of which the rear edges, with respect to the side surfaces, come to lie essentially on the other side of the dividing wall,
- and a base surface consists of two sectional base surfaces which are connected to one another via a connecting edge and to the sectional top surfaces via the rear edges.

The advantages of the invention may be seen, inter alia, in the fact that the downstream edge of the dividing wall is lengthened by the introduction of the rear edges rotated relative to the dividing wall. Consequently, the contact area of the flows to be mixed is increased on the one hand, and further vortices are generated on the other hand by the rear edges placed in the flow. These vortices assist and intensify the vortices of the vortex generator which are generated at the longitudinally directed edges. In addition, the intermixing of the flows to be mixed is increased, since the vortices propagate in the direction of the respectively opposite flow, as a result of which an interwoven flow pattern develops.

From the fluidic point of view, the vortex-generator element has a very low pressure loss when flow occurs around it and it generates vortices without a wake zone. Finally, the element, due to its interior space, which is hollow as a rule, can be cooled in the most varied ways and by diverse means.

It is especially expedient if the two side surfaces enclosing the sweepback angle $\alpha$ as well as the sectional top surfaces of the vortex generator are arranged symmetrically to a plane of symmetry, formed by an axis of symmetry and the connecting edge of the side surfaces. Vortices having identical swirl are thus generated.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 4 shows a plan view of the vortex generators of FIG. 3;

FIG. 5 shows a partial cross-section through a duct with vortex generators arranged therein.

Only the elements essential for understanding the invention are shown.

DESCRIPTION OF THE PREFERRED EMBODIMENTS

Figure 1:
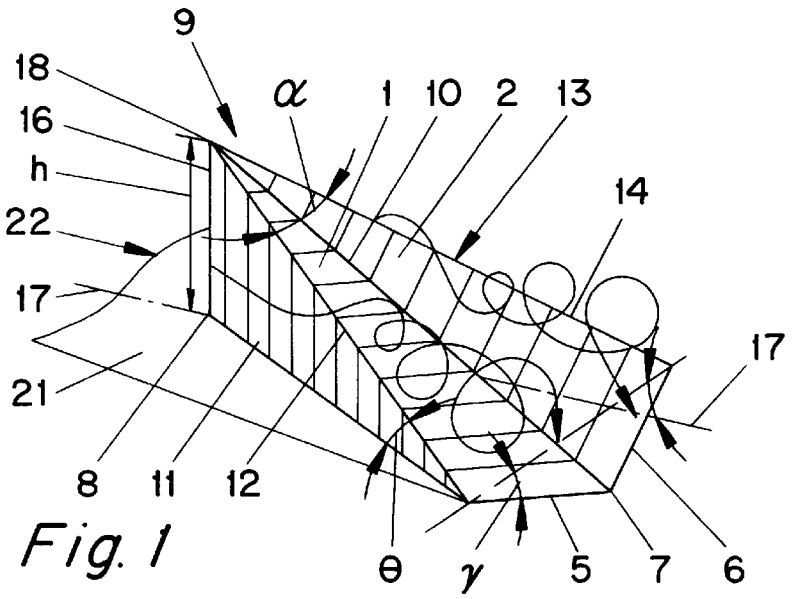
FIG. 1 shows a perspective representation of a vortex generator viewed from above.

Referring now to the drawings, wherein like reference numerals designate identical or corresponding parts throughout the several views, according to FIG. 1 a vortex generator 9 essentially comprises a plurality of triangular surfaces around which flow occurs freely. These are two sectional top surfaces 1, 2, two side surfaces 11, 13 and two sectional base surfaces (not visible in FIG. 1). In their longitudinal extent, these surfaces run at certain angles in the direction of flow.

The two side surfaces 11 and 13 are each disposed perpendicularly on the associated top side 21 of a dividing wall 22, although this need not necessarily be the case. The side surfaces 11, 13, which consist of right-angled triangles, are fixed here by their longer leg to the dividing wall 22. They are oriented in such a way that they form a joint with their shorter leg while enclosing a sweepback angle $\alpha$. The joint is designed as a sharp connecting edge 16 and is likewise disposed perpendicularly to the dividing wall 22. Incorporated in a duct, the cross-section of flow is scarcely impaired by obstruction on account of the sharp connecting edge. An intersection 8 which lies in the dividing wall is formed by the longer legs of the side surfaces 11, 13 and by the connecting edge 16. The two side surfaces 11, 13 enclosing the sweepback angle $\alpha$ are symmetrical in shape, size and orientation and are arranged on either side of a plane of symmetry which is formed by an axis 17 of symmetry and the connecting edge 16. The axis 17 of symmetry is normally parallel to the duct axis and thus with the duct flow.

An essentially longitudinally directed edge 12 of the sectional top surface 1 is flush with the hypotenuse of the side surface 11 projecting into the flow duct. This longitudinal edge 12 runs at a setting angle $\theta$ to the wall 22. A downstream main edge 5 of the sectional top surface 1 lies in a plane perpendicular to the axis 17 of symmetry and is rotated by an angle $\gamma$ relative to the dividing wall 22 so that the rear edge 5 comes to lie below the dividing wall. To assemble the vortex generator 9, therefore, slots have to be made in the dividing wall 22, or the dividing wall must be appropriately adapted.

The sectional top surface 2 is symmetrical to the sectional top surface 1 with regard to the plane of symmetry, formed by the axis 17 of symmetry and the connecting edge 16. Therefore a longitudinally directed edge 14 of the sectional top surface 2 is flush with the hypotenuse of the side surface 13 projecting into the flow duct. The longitudinal edge 14 runs at the setting angle θ to the wall 22. A rear edge 6 of the sectional top surface 2 likewise lies in the plane perpendicular to the axis 17 of symmetry and is rotated by the negative angle γ relative to the dividing wall so that the rear edge 6 comes to lie below the dividing wall 22.

The second longitudinally directed edge of the sectional top surface 1 forms with the second longitudinally directed edge of the sectional top surface 2 a connecting edge 10 which lies in the plane of symmetry formed by the axis 17 of symmetry and the connecting edge 16. The connecting edge 10 forms with the rear edge 5 as well as with the rear edge 6 a point 7 lying at the downstream end of the vortex generator 9. The longitudinal edges 12, 14 form together with the connecting edge 16 and the connecting edge 10 a point 18 lying at the upstream end of the vortex generator 9.

Figure 2:
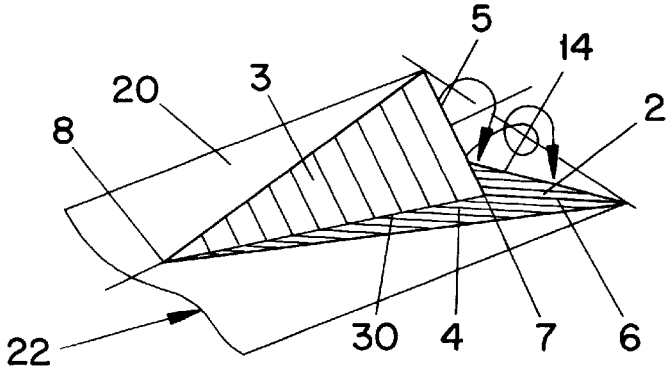
FIG. 2 shows a perspective representation of the vortex generator viewed from below.

According to FIG. 2, the triangular sectional base surface 3 is defined by the rear edge 5 and the intersection 8, and the triangular sectional base surface 4 is defined by the rear edge 6 and the intersection 8. A connecting edge 30 of the sectional base surfaces 3, 4 therefore extends from the point 7 up to the intersection 8.

The vortex generator may of course also be produced without base surfaces, the dividing wall then performing the function of the base surfaces. To this end, the dividing wall must be of serrated configuration at its downstream end, in accordance with the sectional base surfaces. In order to further increase the contact area at the downstream end of the dividing wall, the rear edges of the vortex generator may also lie in various planes which do not run perpendicularly to the axis of symmetry.

Figure 3:
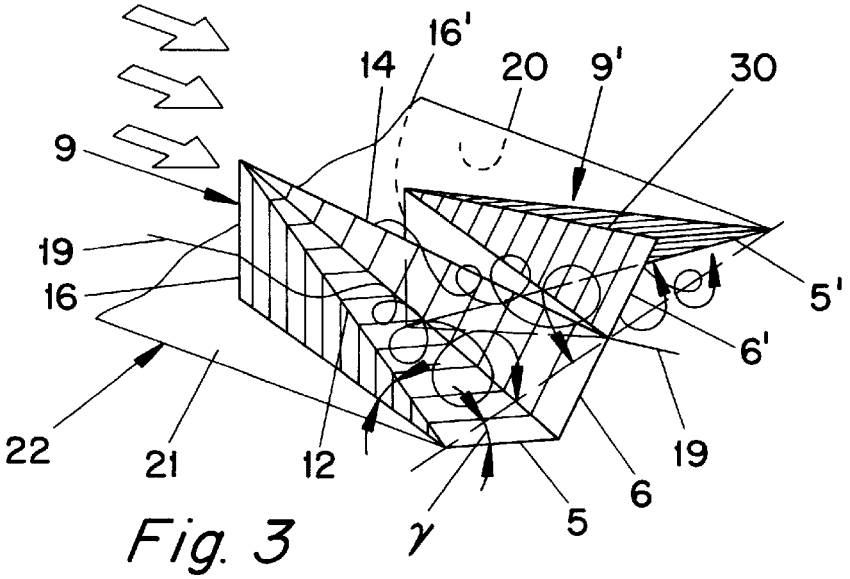
FIG. 3 shows a perspective representation of a plurality of vortex generators.

In FIGS. 3 and 4, a vortex generator 9' on the bottom side 20 of the dividing wall 22 and a vortex generator 9 on the top side 21 of the dividing wall are arranged next to one another. The vortex generator 9' is identical in shape and size to the vortex generator 9; the designations already used above for the vortex generator 9 are therefore also used for the vortex generator 9' but are provided with an apostrophe. The vortex generator 9 can be converted into the vortex generator 9' by a rotation of 180° about an axis 19 of rotation. The axis 19 of rotation lies in the dividing wall 22, is parallel to the axis 17 of symmetry and passes through the intersection of longitudinal edge 14 and rear edge 6.

The connecting edge 16 of the two side surfaces 11, 13 always forms the upstream edge of the vortex generators 9, 9'. The sharp connecting edge 16 is that location which is acted upon first by the duct flow. The rear edges 5, 6, 5', 6' of the top surfaces running transversely to the dividing wall 22 around which flow occurs are therefore the edges acted upon last by the duct flow.

The vortex generators 9' may of course be of different design to the vortex generators 9, in which case the vortex generators are always of similar geometry to the basic configuration shown. This is advantageous, for example, for mixing physically different flows.

The mode of operation of the vortex generator is as follows: when flow occurs around the edges 12 and 14, the flow is converted into a pair of oppositely running directed vortices. The vortex axes lie in the axis of the flow. The geometry of the vortex generators is selected in such a way that no backflow zones develop during the vortex generation. The vortices of the vortex generator 9 rotate above and along the top surfaces 1, 2 and head for the dividing wall 22 on which the vortex generator is mounted. The vortices of the vortex generator 9' rotate below and along the top surfaces and likewise head for the dividing wall 22.

The swirl coefficient of the vortex is determined by appropriate selection of the setting angle θ and/or the sweepback angle α. As the angles increase, the vortex intensity or the swirl coefficient is increased, and the location of the vortex breakdown— provided this is actually desired—shifts upstream right into the region of the vortex generator itself. Depending on use, these two angles θ and α are predetermined by design conditions and by the process itself. Then only the height h of the connecting edge 16 has to be adapted. By the selection of the angle γ, the vortices are influenced in such a way that the larger γ is selected to be, the better is the intermixing of the partial flows. However, the angle γ cannot be selected to be of any desired magnitude, since the pressure drop also increases as γ increases.

It is pointed out that the shape of the dividing wall 22 around which flow occurs is not essential for the mode of operation of the invention. Instead of the straight shape of the dividing wall 22 shown in the figures, it could also be an annular or hexagonal or other cross-sectional shape. In the case of a curved dividing wall, the above statement that the side surfaces are disposed perpendicularly on the wall must of course be qualified. The decisive factor is that the connecting edge 16 lying on the line 17 of symmetry is disposed perpendicularly on the corresponding wall. In the case of annular walls, the connecting edge 16 would therefore be oriented radially.

FIG. 5 shows a partial view of a duct having a fitted dividing wall 22. The cross-section through which flow occurs is subdivided by this dividing wall 22 into two sectional ducts having the duct heights H1 and H2. The top side 21 of the dividing wall 22 forms a duct wall of the top duct 41, and the bottom side 20 of the dividing wall 22 forms a duct wall of the bottom duct 42. The same medium could flow at a different velocity through the two ducts, or the media could be flowing fluids of different density or chemical composition which have to be mixed in the quickest way into a certain uniformly distributed concentration.

In each case an identical number of vortex generators 9, 9' are lined up with gaps in between on the two duct walls 20 and 21 of the dividing wall. The height h1 of the elements 9 as well as the height h2 of the elements 9' are, for example, about 90% of the associated duct heights H1 and H2. In FIG. 5 the flow takes place perpendicularly out of the drawing plane; the elements 9, 9' are oriented in such a way that the connecting edges 16 are directed against the flow. The sense of rotation of the generated vortices in the region of the connecting edge is descending, i.e. heading toward the respective duct wall 20, 21 on which the vortex generator is arranged. At the end of the dividing wall 22, i.e. at the rear edges 5, 6, 5', 6', the vortex flows generated on the two sides of the dividing wall 22 are forced into one another, in the course of which the desired intermixing occurs.

The vortices having identical swirl in the sectional ducts 41, 42 combine to make one large vortex having a uniform sense of rotation. The axis of rotation of this large vortex is essentially the axis 19 of rotation.

The vortex generators 9, 9' can have different heights h1, h2 in the ducts 41, 42 relative to the duct heights H1, H2. As a rule, the heights h1, h2 of the connecting edges 16, 16' of the vortex generators 9, 9' will be matched to the respective duct heights H1, H2 in such a way that the generated vortices directly downstream of the vortex generator already attain such a size that the full duct height H1+H2 or the full height of the duct part allocated to the vortex generator is filled, which leads to a uniform distribution in the cross-section acted upon. A further criterion which can have an influence on the ratio h/H to be selected is the pressure drop which occurs when flow takes place around the vortex generator. It goes without saying that the pressure-loss coefficient also increases as the ratio h/H increases.

The invention is of course not restricted to the exemplary embodiments and examples of use shown and described. Due to the specific design and dimensioning of the vortex generators, a simple means of controlling the mixing operation according to requirement at given flows is available.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patents of the United States is:

1. A mixing device for mixing two or more flowing fluids having the same or a dissimilar mass flow, comprising:

a flow channel for fluids to be mixed having a dividing wall, a plurality of vortex generators mounted at a downstream end of the dividing wall, each vortex generator projecting into the flow channel to provide surfaces around which flow occurs freely, the vortex generators being arranged next to one another across the flow channel, each vortex generator having two side surfaces with a first longitudinally directed edge attached to a first side of the dividing wall, leading edges of the side surfaces being connected at a lead connecting edge with the side surfaces oriented with one another at a sweepback angle, second longitudinally directed edges of the side surfaces being disposed in the flow channel and oriented at a setting angle to the wall, the lead connecting edge being oriented perpendicularly to the wall and providing an upstream edge acted upon first by the flow, a top surface including two sectional top surfaces, with longitudinally directed edges of the sectional top surfaces being joined with the second longitudinally directed edges of the side surfaces, and the sectional top surfaces being connected to one another by a top connecting edge, downstream rear edges of the sectional top surfaces being oriented at an angle with the dividing wall so that the rear edges lie substantially opposite the first side of the dividing wall, and a base surface including two sectional base surfaces which are connected to one another by a bottom connecting edge and connected to the sectional top surfaces by the rear edges.

2. The mixing device as claimed in claim 1, wherein the base surface is formed by the dividing wall, and wherein the two side surfaces and two sectional top surfaces of each vortex generator are mounted on the dividing wall.

3. The mixing device as claimed in claim 1, wherein the rear edges of the sectional top surfaces of each vortex generator are arranged in a plane perpendicular to an axis of symmetry of the vortex generator.

4. The mixing device as claimed in claim 1, wherein the two side surfaces and the sectional top surfaces of each vortex generator are arranged symmetrically to a plane of symmetry, defined by the top connecting edge and the lead connecting edge.

5. The mixing device as claimed in claim 1, wherein at least one of the lead connecting edge and the longitudinally directed edges of the top sectional surfaces of each vortex generator are designed to be sharp.

6. The mixing device as claimed in claim 1, wherein the dividing wall is arranged in a double-duct container to form two sectional ducts, and wherein a same plurality of vortex generators is arranged in each sectional duct, the vortex generators being fastened on both sides of the dividing wall.

7. The mixing device as claimed in claim 6, wherein a ratio of a height of the vortex generators measured along the lead connecting edge to a height of at least one of the sectional duct measured transverse to the flow direction is selected so that generated vortices directly downstream of the vortex generators fills at least one of a full sectional-duct height and a full height of the double duct container.

* * * * *